US006029328A

United States Patent [19]

Ballarati

[11] Patent Number: 6,029,328

[45] Date of Patent: Feb. 29, 2000

[54] PROCESS AND EQUIPMENT FOR BULK-TEXTURIZING AND SIMULTANEOUS INTERLACING OF THERMOPLASTIC YARNS, USING HEATING FLUIDS

[75] Inventor: Vito Ballarati, Imola, Italy

[73] Assignee: G.I.B.A. S.p.A., Italy

[21] Appl. No.: 09/025,894

[22] Filed: Feb. 18, 1998

[30] Foreign Application Priority Data

Feb. 19, 1997 [IT] Italy ..... MI97A0351

[51] Int. Cl.[7] ..... D02G 1/16

[52] U.S. Cl. ..... 28/271; 28/274; 28/258; 28/281

[58] Field of Search ..... 28/172.2, 271, 28/258, 220, 178, 274, 281

[56] References Cited

U.S. PATENT DOCUMENTS

| | | | |
|---|---|---|---|
| 3,973,386 | 8/1976 | Gorrafa | 28/258 |
| 4,644,622 | 2/1987 | Bauer et al. | 28/172.2 |
| 5,142,754 | 9/1992 | Krenzer | 28/271 |
| 5,794,427 | 8/1998 | Cavedon et al. | 28/271 |

FOREIGN PATENT DOCUMENTS

| | | |
|---|---|---|
| 0152919 | 8/1985 | European Pat. Off. . |
| 2187481 | 9/1987 | United Kingdom . |
| 8901538 | 2/1989 | WIPO . |
| 9113197 | 9/1991 | WIPO . |

*Primary Examiner*—Amy Vanatta
*Attorney, Agent, or Firm*—Hedman, Gibson & Costigan, P.C.

[57] ABSTRACT

Process for bulk-texturizing and simultaneous interlacing of medium or high-shrinkage multi-filament yarns carried out with a device in which the yarns are made to pass into single or multiple chambers where the yarns come under jets of steam or other gaseous fluid that cause simultaneously their shrinkage, bulk-texturizing and interlacing.

8 Claims, 4 Drawing Sheets

PROCESS AND EQUIPMENT FOR BULK-TEXTURIZING AND SIMULTANEOUS INTERLACING OF THERMOPLASTIC YARNS, USING HEATING FLUIDS

DESCRIPTION

The present invention regards a method and corresponding equipment for the preparation of multi-filament yarns made of thermoplastic material, bulk-texturized and interlaced, wound individually on reels or in the form of a set of parallel yarns (warp chain) wound on a warp beam, starting from completely or partially stretched thermoplastic yarns with medium or high shrinkage, according to which the bulk-texturizing and interlacing are carried out simultaneously during the phase of hot-shrinkage of the yarn. The yarns obtained using the method described in the present invention can be used both as warp yarns and as weft yarns, as well as yarns for knitting machines in the manufacture of textile articles.

REFERENCES TO PRIOR ART

There are basically three main processes known for obtaining bulk-texturized multi-filament yarns, namely:

1. Texturizing (False Twist)

The yarn is bulk-texturized using the false twist (texturizing) system. Bulk-texturizing may be carried out at the same time as the stretching when the process is carried out on partially oriented yarn (POY), or else is carried out starting from completely stretched yarn which in all cases undergoes twisting, heating, and untwisting.

This treatment causes a deformation of the filaments with a consequent bulk-texturizing of the yarn. With this system, the filaments are parallel to one another and need to undergo knotting (interlacing) to facilitate the subsequent textile operations of weaving, warping, etc.

This operation is normally carried out with compressed-air interlacing devices. The process is performed on machines called stretching-texturizing machines, which are very costly and complicated. The yarn thus obtained is then warped to achieve the beam for weaving or rectilinear knitting.

2. Air Bulk-Texturizing (Using Compressed-Air Nozzles)

The yarn is bulk-textured using various systems of compressed-air nozzles. Bulk-texturizing is achieved cold by means of powerful jets of air which distort the individual filaments, creating many loops and knots which swell out the yarn. This process is very costly in terms of consumption of power. It is carried out on machines called air-texturizers, which are very costly, consume a lot and have low productivity.

Furthermore, air with relatively high pressure is required.

The yarn obtained using this process is not very heat-stable since it is subject to considerable shrinking in hot water. The yarn thus obtained is then warped to achieve the beam for weaving or rectilinear knitting.

3. Crimping (Compression in Crimping Chambers)

The yarn is bulk-texturized by means of creases obtained on the filaments of the yarn via mechanical compression with hot air or steam in a metal tube. After compression and creasing of the filaments, the yarn is stretched out of the chambers, air-interlaced and wound on reels turning at different speeds. This process is very costly and may be applied only to yarns of medium and large yarn count.

For low-yarn count textile yarns this process has not yet been developed.

PROCESS ACCORDING TO THE INVENTION

The starting yarn which is to undergo the interlacing and simultaneous bulk-texturizing process according to the invention is of the continuous multi-filament type, consisting of substantially stretched thermoplastic material, which is subjected to a considerable hot shrinkage (comprised between 9% and 45%). Excellent results are obtained with a shrinkage of the yarn comprised between 15% and 35%. The percentage values reported here and in the following are relevant to the shrinkage in boiling water.

With the term "substantially stretched" it is meant that the yarn has a residual stretching which in general can be comprised between 25% and 60% and, in the case of polyamidic material, between 25% and 50%.

As starting material it is convenient to use partially oriented yarn (POY) coming directly from spinning and wound on bobbins.

In this latter case, the process involves an initial phase in which the yarn is further and substantially stretched with low-temperature steam heating. The use of steam in this stretching phase is advantageous because the yarn obtained presents a high residual shrinkage.

01—Reel frame

02—Reed

03—Inlet trio (three rolls set)

04—DSI steam heater

05—Outlet trio

06—Reed

07—Steam chamber

08—Tensioning trio

09—Take-up winder

Figure 1:
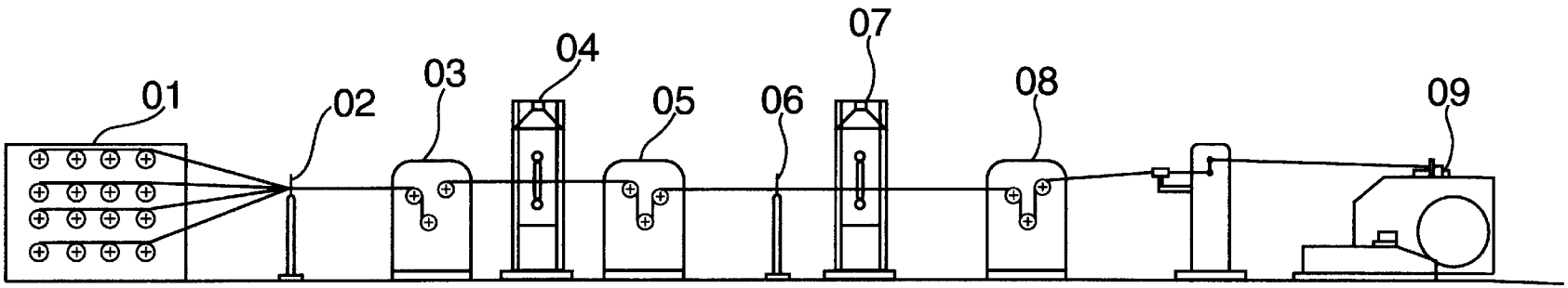
FIG. 1 shows the apparatus where the execution of the process according to the invention, when the starting material is multi-filament yarn of the POY type, is performed, the reference numbers being as follows.
Figure 2:
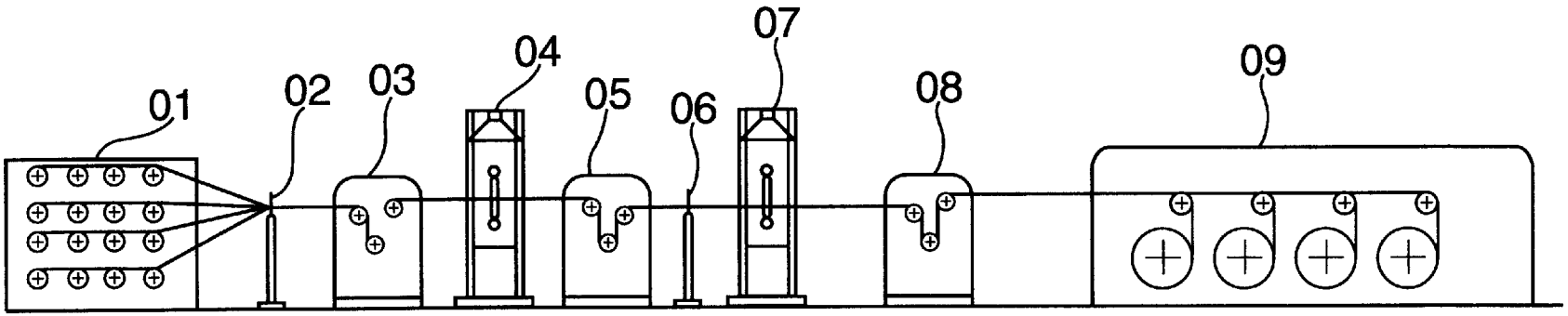
Figure 3:
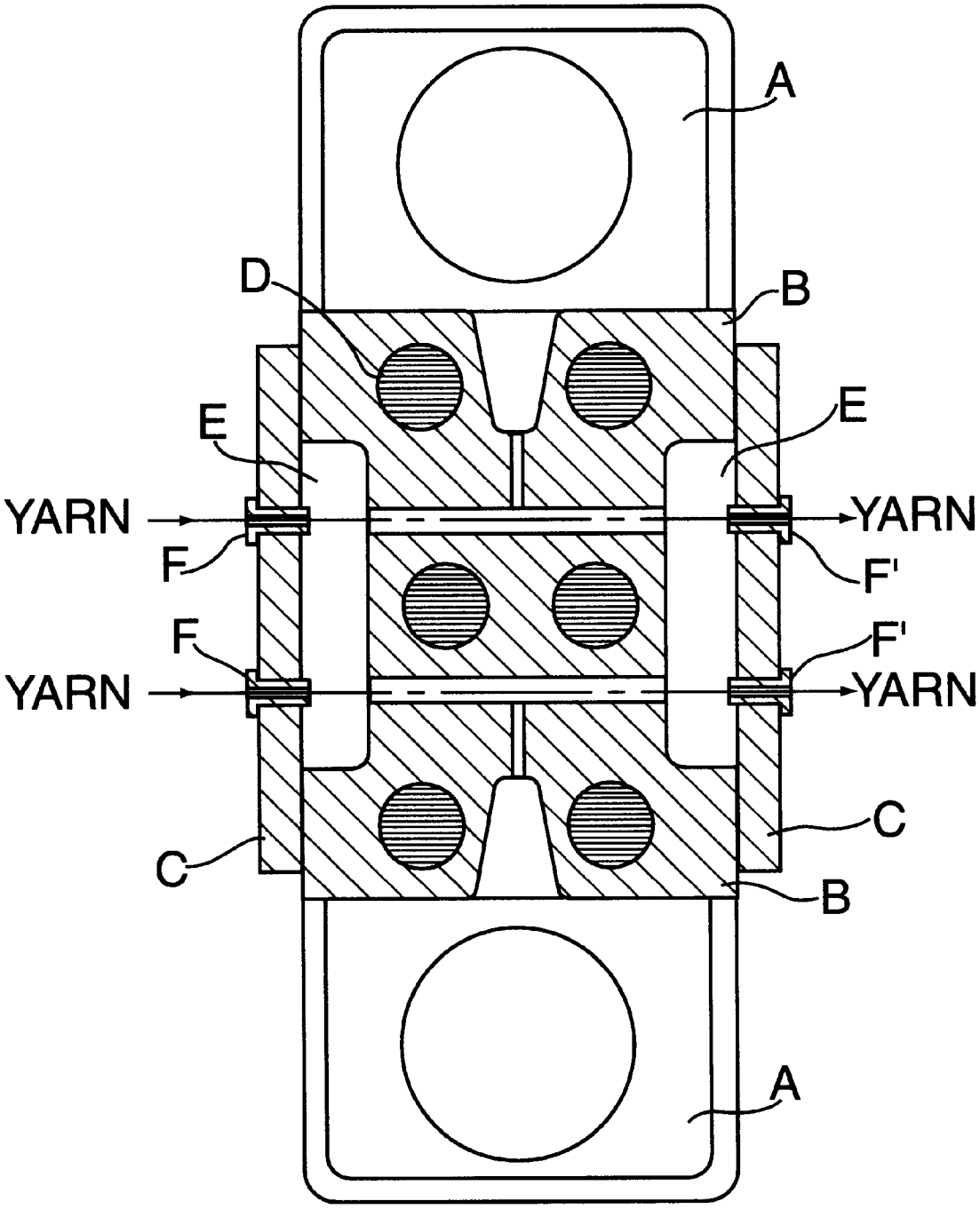
Figure 4:
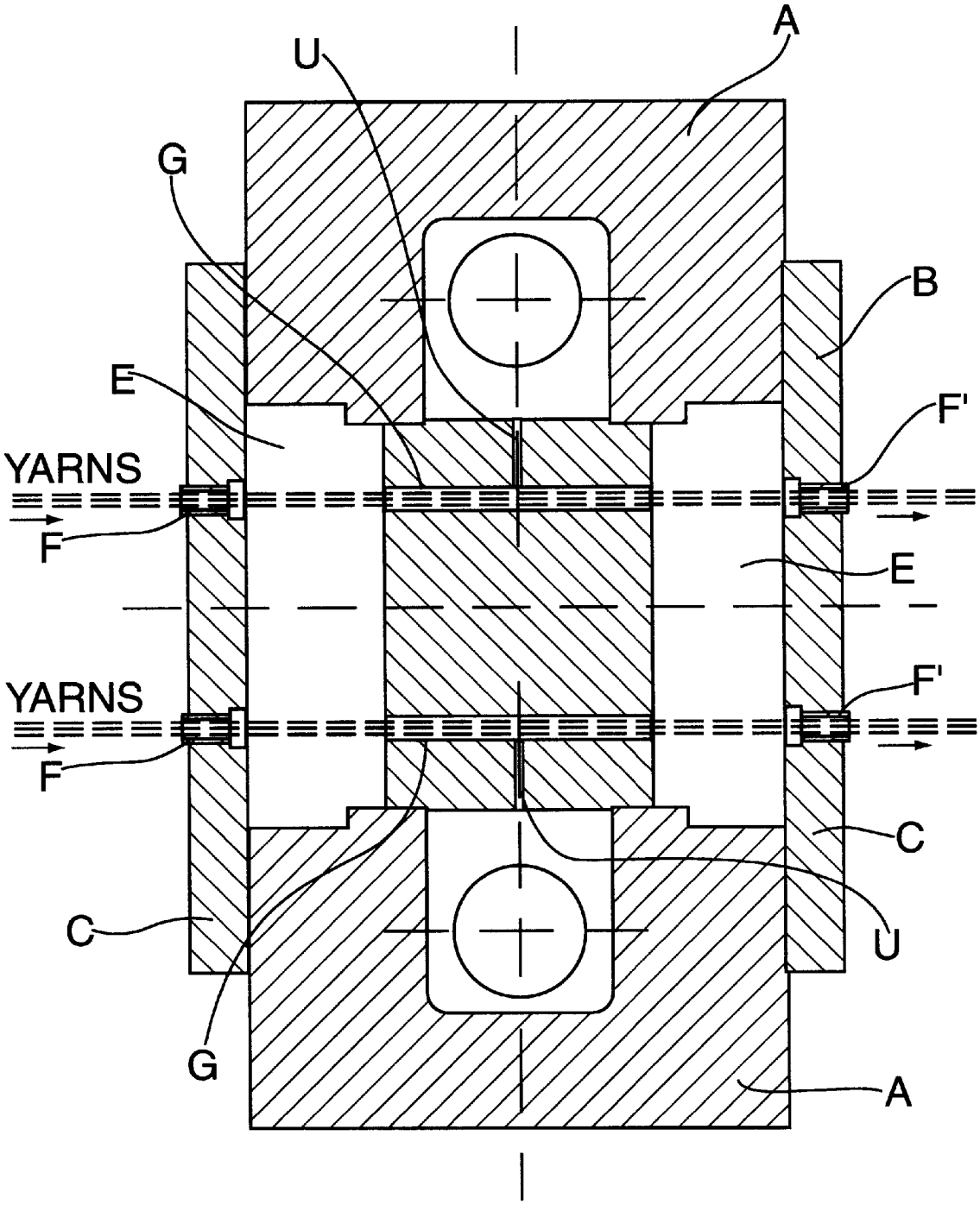

FIG. 2 shows the same apparatus of FIG. 1, where only the system of taking up the yarn changes and consequently the reference numbers are the same with the only exception of 09, which represents the Bobins collector;

FIG. 3 represents in detail the steam chamber (position 07) of FIG. 1;

FIG. 4 shows the same device of FIG. 3, where no heating elements are provided.

DESCRIPTION OF THE PREFERRED EMBODIMENTS

The execution of the process according to the invention is now described with reference to the apparatus and to the steam chamber device represented in the FIGS. 1–4.

The process according to the invention is carried out by an apparatus, illustrated in FIGS. 1 and 2, where the starting material is multi-filament yarn of the POY type.

In FIG. 2 the apparatus is identical to the one of FIG. 1; only the system of taking up the yarn changes: in the case of FIG. 2, the yarn is wound on a single bobbin for each yarn, whereas in FIG. 1 the winding of the set of parallel yarns comes about in the form of a beam for knitting or fraction of warp chain for weaving.

From a set of bobbins arranged on a reel frame [FIGS. 1 and 2 (Pos. 1)], a set of yarns is wound off, which are arranged parallel to one another and set at a prearranged distance by means of a reed [FIGS. 1 and 2 (Pos. 2)], and sent to the inlet roll trio [FIGS. 1 and 2 (Pos. 3)], the rolls of which turn at a constant peripheral speed.

As the yarns come off these rolls, they enter single stretching chambers [FIGS. 1 and 2 (Pos. 4)], into which steam is injected. When the yarns come out of the stretching chambers, they are stretched by an outlet trio device [FIGS. 1 and 2 (Pos. 5)], the rolls of which turn at a peripheral speed higher than that of the inlet trio device. This generates the necessary stretching tension on the yarns.

The yarns stretched between the two sets of rolls [FIGS. 1 and 2 (Pos. 3 and Pos. 5)] and heated by the steam are completely stretched.

The steam-stretched yarns have very high residual shrinkage. The yarns thus obtained, which have a medium or high shrinkage, are sent on, always kept parallel to one another by means of reeds [FIGS. 1 and 2 (Pos. 6)] into the device for bulk-texturizing and simultaneous interlacing which comprises single chambers (one for each yarn) or multiple chambers (one chamber for a number of yarns [FIGS. 1 and 2 (Pos. 7)], into which steam or another fluid at a suitable temperature is injected through side nozzles. The jet of steam or other fluid hits a yarn in a direction perpendicular to the direction of advance of the yarn or at a different angle.

In FIG. 3 it is represented the device by showing with F the inlet nozzle of the yarn and with F' the outlet nozzle: these nozzles act for keeping the yarn in the suitable central position in the tubular chamber G wherein it is subjected to the steam jet outcoming from the nozzle U and having direction transverse with respect to the direction of advance of the yarn. The steam is then discharged through the chambers E. The device comprises heating elements D in order to avoid partial condensation of the steam and the steam chamber A wherein the pressure of the steam fed to nozzles U is adjusted. With C it is shown the plate equipped with the yarn-guide nozzles F and F' and with B the plate with built-in steam nozzles U.

In FIG. 4 it is represented the device wherein there are multiple chambers that is chambers in which a plurality of yarns are caused to pass contemporaneously instead of a single yarn. The steam nozzles can be also more that one for each chamber. The reference letters have the same meaning as in FIG. 3.

When the yarns come out of the steam chambers, they are stretched by a roll device [FIGS. 1 and 2 (Pos. 8)] turning at a peripheral speed lower than that of the in-coming device. The peripheral speed of the outlet rolls is comprised in general between 55% and 91% of the inlet speed of the yarn, in function of the shrinkage percentage of the treated yarn. Under the action of the steam, the yarn thus fed in at a higher rate shrinks, the individual filaments are deformed in a random manner, and the yarn is naturally bulk-texturized as a result of the high shrinkage that the steam causes the yarn to undergo. During this phase, the yarn shrinks with a very low tension. Under the combined action of the jet of steam (or other suitable fluid at an appropriate temperature) and of the low tension caused by the set of outlet rolls [FIGS. 1 and 2 (Pos. 8)], in the aforesaid chamber simultaneously shrinkage occurs with consequent bulk-texturizing and interlacing of the yarn filaments. The paths of the yarns in the chamber may vary within wide limits from 10 to 100 cm or more. In practice, however, the path along which the treatment is carried out is much shorter, i.e., generally around 10 cm.

The completely stretched bulk-texturized and interlaced yarns thus obtained are sent to bobbin winder for taking up the individual yarns on bobbins or reels [FIG. 2 (Pos. 9)], or else are wound parallel and close to one another on a beam for knitting or fraction of warp chain for weaving.

The substantial and most original feature of the process according to the present invention lies in the fact that bulk-texturizing takes place naturally, as a result of the jet of steam which causes the filaments making up the yarn to shrink instantaneously and under control. Instead of steam, it is possible to use another gaseous fluid, in particular, air. However, steam is the most convenient and advantageous means and the one that gives the best results. In general, steam can be used at the pressure of 1 to 10 bar, and more in general a gaseous fluid can be used having a temperature of between 100° C. and 230° C.

Shrinkage is instantaneous and takes place with the tension kept at a very low value. This fact allows the jet of steam to interlace the filaments while they are being bulk-texturized. The levels of bulk-texturizing thus obtained on the yarn transform the appearance of the yarn, which, from being smooth and shiny, becomes more opaque and voluminous, bestowing on the fabric produced characteristics that are closer to the fabric produced with natural yarn, as well as a more comfortable feel.

Special effects may be obtained if the filaments that make up the individual threads have a differentiated shrinkage and/or section.

In particular it is possible to use a "doubled" yarn made up from two different yarns.

Owing to the different shrinkage which occurs during the steam treatment, the obtained yarn shows a very high bulkiness and highly smooth feel. The fabric manufactured from this type of yarn shows a feel like "peach skin" without resorting to the grinding of the fabric.

The fabrics produced with the yarns obtained according to the invention show new characteristics. As may be readily understood, the big advantage of this invention is that of enabling bulk-texturizing of a number of yarns at the same time as a result of the natural shrinkage of the filaments making them up.

This invention makes it possible to avoid conventional processes of bulk-texturizing which entail big investments, are difficult to manage, require a lot of power for operation, and as a result are very costly.

This invention is illustrated by the following examples, which, however, do not exhaust the possibilities of execution of the said invention.

EXAMPLE NO. 1

A set of 1160 bobbins of ordinary POY polyester are put on the reel frame of a stretching-warping machine.

The polyester yarn has the following characteristics:

| | |
|---|---|
| Yarn count | 85 dtex |
| Number of filaments | 36 |
| Section of filaments | circular |
| Breaking load | 238 g |
| Elongation | 158% |
| Uster | 1.1 |
| Knotting | 10–13 knots/m |

The yarns are warped with a reel frame tension of 5 g and aligned by means of a reed. The yarns are anchored to three cold cylinders rotating at a peripheral speed of 305 m/min.

As they come off the cylinders, the 1160 yarns are sent into a stretching steam interlacing device (DSI) having a capacity of 1380 yarns arranged on four levels. As the yarns come out of the stretching steam interlacing device, they are pulled by three rolls turning at a peripheral speed of 500 m/min.

During this operation, the yarns are stretched with a stretching ratio of approx. 1:1.64. As they come off the second set of three stretching rolls, the yarns (which show a shrinkage of 18%) are sent into a device for steam shrinkage and interlacing consisting of a number of individual steam chambers, one for each yarn, of the type disclosed by FIG. 3. The length of the run into the single chamber is of the order of 15 cm. Steam at 3 bar was fed to the steam chambers. The second set of three rolls rotate at a peripheral speed of 425 m/min. During this operation, the yarns shrink, are bulk-texturized and interlaced.

The mean characteristics of these yarns are:

| | |
|---|---|
| Count | 56 dtex |
| Breaking load | 230 g |
| Elongation (final) | 50% |
| Shrinkage in boiling water | 3% |
| Uster | 1.1 |
| Knotting | very high |
| Bulk-texturizing | quite good |

With this system, 3 warp beams are produced which are woven on warp chain looms operating at a working rate of 1000 strokes per minute.

The fabric thus obtained is dyed with a beam dyeing apparatus. The dye used is dispersed blue 056. Upon inspection, the fabric presents a soft feel, the typical appearance of a fabric produced with bulk-texturized yarn, and an excellent degree of uniformity of dye.

EXAMPLE NO. 2

A set of 1160 bobbins of POY polyester are put on the reel frame of a stretching-warping machine. The POY yarn is made up of filaments having sections considerably different from one another, which, after stretching, will undergo a differentiated shrinkage. The starting polyester yarn has the following characteristics:

Yarn consisting of 2 different doubled threads, namely:

| | 1st thread | 2nd thread |
|---|---|---|
| Count | 64 dtex | 64 dtex |
| Number of filaments | 68 | 8 |
| Section of filaments | circular | circular |
| Toughness (breaking load) | 138 g | 145 g |
| Elongation | 118% | 165% |

The yarns are warped with a tension of 7 g and aligned by means of a reed. The yarns are anchored to three cold cylinders rotating at a peripheral speed of 360 m/min. As they come off the cylinders, the 1160 yarns are sent into a stretching steam interlacing device having a capacity of 1380 yarns arranged on four levels.

When they come out of the stretching steam interlacing device, the yarns are pulled by three rolls turning at a peripheral speed of 500 m/min.

During this operation, the yarns are stretched with a stretching ratio of approx. 1:1.4. As they come off the second set of three stretching rolls, the yarns (which show a shrinkage of 5% to 6% for the 1st yarn and of 24% for the 2nd yarn) are sent into a device for steam shrinkage and interlacing of the type disclosed in Example 1. The steam fed to this device is at 3 bar.

The second set of three rolls rotate at a peripheral speed of 425 m/min. During this operation, the 0.57-dtex filaments shrink much less than the 4.87-dtex ones, creating continuous loops that bestow bulk on the yarn and give it a very soft surface feel.

During this operation, the steam also exerts an interlacing action on the filaments. The mean characteristics of this doubled yarn are:

| | |
|---|---|
| Count | 89 dtex |
| Breaking load | 302 g |
| Elongation (final) | 60% |
| Shrinkage in boiling water | 3% |

With this system, three warp beams are produced, which are woven on warp chain looms operating at a working rate of 1000 strokes per minute. The fabric thus obtained is dyed with a beam dyeing apparatus. The dye used is dispersed blue 056.

Upon inspection, the fabric presents a soft feel and an excellent degree of uniformity of dye. The fabric moreover presents a new and characteristic appearance and a feel like a "peach skin".

I claim:

1. A process for bulk-texturizing and simultaneously interlacing continuous multi-filament, substantially stretched thermoplastic yarns having a shrinkage not lower than 9%, comprising the steps of (a) advancing said yarns through at least one chamber at an inlet speed, said chamber comprising at least one let for delivering steam or other gaseous fluid, (b) subjecting said yarns to said jets of steam or other gaseous fluid at temperatures of from about 100 to about 230 degrees C. wherein said jets are transverse with respect to the direction of advance of said yarns to effectuate simultaneous shrinkage, bulk-texturizing and interlacing of said yarns, and (c) reducing the speed of the yarns exiting said chamber to a speed between about 55% and about 91% of the inlet speed of the yarns, wherein said speed reduction effectuates control of said shrinkage.

2. The process according to claim 1 wherein the yarns used in step (a) are prepared by treating partially oriented yarns (POY) in a steam stretching-interlacing device to obtain said substantially stretched yarns.

3. Process for the bulk-texturizing and simultaneous interlacing according to claim 1 wherein the yarns to be treated are characterized by a shrinkage value between 9% and 45%.

4. Process for the bulk-texturizing and simultaneous interlacing according to claim 1 wherein steam at 1 to 10 bar is used.

5. The process according to claim 1 further comprising the step of (d) forming warp chains from said bulk-texturized and interlaced yarns.

6. The process according to claim 1, wherein said substantially stretched yarns comprise doubled yarns comprising filaments having different shrinkage, different section or different shrinkage and different section values.

7. The process according to claim 1 wherein the continuous multifilament, substantially stretched yarns comprise polyester.

8. The process according to claim 1 further comprising the step of forming fractions of warp for plane weaving from said bulk-texturized and interlaced yarns.

* * * * *